US010230161B2

(12) United States Patent
Baron et al.

(10) Patent No.: US 10,230,161 B2
(45) Date of Patent: Mar. 12, 2019

(54) LOW-BAND REFLECTOR FOR DUAL BAND DIRECTIONAL ANTENNA

(71) Applicant: ARRIS Enterprises LLC, Suwanee, GA (US)

(72) Inventors: Bernard Baron, Mountain View, CA (US); Chia-Ching Lin, San Jose, CA (US); Victor Shtrom, Los Altos, CA (US)

(73) Assignee: ARRIS Enterprises LLC, Suwanee, GA (US)

( * ) Notice: Subject to any disclaimer, the term of this patent is extended or adjusted under 35 U.S.C. 154(b) by 0 days.

(21) Appl. No.: 14/217,392

(22) Filed: Mar. 17, 2014

(65) Prior Publication Data

US 2014/0285391 A1 Sep. 25, 2014

Related U.S. Application Data

(60) Provisional application No. 61/800,854, filed on Mar. 15, 2013.

(51) Int. Cl.

| | |
|---|---|
| ***H01Q 15/00*** | (2006.01) |
| ***H01Q 1/36*** | (2006.01) |
| ***H01Q 9/04*** | (2006.01) |
| ***H01Q 9/00*** | (2006.01) |
| ***H01Q 1/52*** | (2006.01) |
| ***H01Q 9/42*** | (2006.01) |
| ***H01Q 19/32*** | (2006.01) |
| ***H01Q 25/00*** | (2006.01) |

(52) U.S. Cl.

CPC ..... *H01Q 1/36* (2013.01); *H01Q 1/52* (2013.01); *H01Q 9/00* (2013.01); *H01Q 9/04* (2013.01); *H01Q 9/42* (2013.01); *H01Q 15/00* (2013.01); *H01Q 19/32* (2013.01); *H01Q 25/00* (2013.01)

(58) Field of Classification Search

CPC ..... H01Q 15/0013; H01Q 9/04; H01Q 1/38; H01Q 15/00; H01Q 9/00

USPC ..... 343/700 MS, 702, 837, 895, 843, 745

See application file for complete search history.

(56) References Cited

U.S. PATENT DOCUMENTS

| | | | |
|---|---|---|---|
| 723,188 | A | 3/1903 | Tesla |
| 725,605 | A | 4/1903 | Tesla |
| 1,869,659 | A | 8/1932 | Broertjes |
| 2,292,387 | A | 8/1942 | Markey et al. |
| 3,488,445 | A | 1/1970 | Chang |

(Continued)

FOREIGN PATENT DOCUMENTS

| | | |
|---|---|---|
| EP | 352 787 | 1/1990 |
| EP | 1 608 108 | 12/2005 |

(Continued)

OTHER PUBLICATIONS

European Application No. 11827493.5 Extended European Search Report dated Nov. 6, 2014.

(Continued)

*Primary Examiner* — Hai V Tran

(74) *Attorney, Agent, or Firm* — Stewart M. Wiener

(57) ABSTRACT

A dual band directional antenna with low frequency band reflectors that form desired antenna patterns in a low frequency band while remaining transparent to a higher frequency band. As a result of such frequency transparency, pattern changes in the lower frequency bands do not affect patterns in the higher band frequencies.

12 Claims, 3 Drawing Sheets

(56) References Cited

U.S. PATENT DOCUMENTS 3,568,105 A 3/1971 Felsenheld et al.
3,577,196 A 5/1971 Pereda
3,846,799 A 11/1974 Gueguen
3,918,059 A 11/1975 Adrian
3,922,685 A 11/1975 Opas
3,967,067 A 6/1976 Potter
3,982,214 A 9/1976 Burns
3,991,273 A 11/1976 Mathes
4,001,734 A 1/1977 Burns
4,145,693 A 3/1979 Fenwick
4,176,356 A 11/1979 Foster et al.
4,193,077 A 3/1980 Greenberg et al.
4,253,193 A 2/1981 Kennard
4,305,052 A 12/1981 Baril et al.
4,513,412 A 4/1985 Cox
4,554,554 A 11/1985 Olesen et al.
4,587,524 A 5/1986 Hall
4,733,203 A 3/1988 Ayasli
4,814,777 A 3/1989 Monser
4,845,507 A 7/1989 Archer et al.
4,975,711 A 12/1990 Lee
5,063,574 A 11/1991 Moose
5,097,484 A 3/1992 Akaiwa
5,132,698 A 7/1992 Swineford
5,173,711 A 12/1992 Takeuchi et al.
5,203,010 A 4/1993 Felix
5,208,564 A 5/1993 Burns et al.
5,220,340 A 6/1993 Shafai
5,282,222 A 1/1994 Fattouche et al.
5,291,289 A 3/1994 Hulyalkar et al.
5,311,550 A 5/1994 Fouche et al.
5,373,548 A 12/1994 McCarthy
5,507,035 A 4/1996 Bantz
5,532,708 A 7/1996 Krenz et al.
5,559,800 A 9/1996 Mousseau et al.
5,610,617 A 3/1997 Gans et al.
5,629,713 A 5/1997 Mailandt et al.
5,754,145 A 5/1998 Evans
5,767,755 A 6/1998 Kim et al.
5,767,809 A 6/1998 Chuang et al.
5,786,793 A 7/1998 Maeda et al.
5,802,312 A 9/1998 Lazaridis et al.
5,964,830 A 10/1999 Durrett
5,990,838 A 11/1999 Burns et al.
6,006,075 A 12/1999 Smith et al.
6,011,450 A 1/2000 Miya
6,018,644 A 1/2000 Minarik
6,031,503 A 2/2000 Preiss, II et al.
6,034,638 A 3/2000 Thiel et al.
6,052,093 A 4/2000 Yao et al.
6,091,364 A 7/2000 Murakami et al.
6,094,177 A 7/2000 Yamamoto
6,097,347 A 8/2000 Duan et al.
6,101,397 A 8/2000 Grob et al.
6,104,356 A 8/2000 Hikuma et al.
6,166,694 A 12/2000 Ying
6,169,523 B1 1/2001 Ploussios
6,204,825 B1 3/2001 Wilz
6,239,762 B1 5/2001 Lier
6,252,559 B1 6/2001 Donn
6,266,528 B1 7/2001 Farzaneh
6,292,153 B1 9/2001 Aiello et al.
6,307,524 B1 10/2001 Britain
6,317,599 B1 11/2001 Rappaport et al.
6,323,810 B1 11/2001 Poilasne et al.
6,326,922 B1 12/2001 Hegendoerfer
6,337,628 B2 1/2002 Campana et al.
6,337,668 B1 1/2002 Ito et al.
6,339,404 B1 1/2002 Johnson et al.
6,345,043 B1 2/2002 Hsu
6,356,242 B1 3/2002 Ploussios
6,356,243 B1 3/2002 Schneider et al.
6,356,905 B1 3/2002 Gershman et al.
6,377,227 B1 4/2002 Zhu et al.
6,392,610 B1 5/2002 Braun et al.
6,404,386 B1 6/2002 Proctor, Jr. et al.
6,407,719 B1 6/2002 Ohira et al.
RE37,802 E 7/2002 Fattouche et al.
6,414,647 B1 7/2002 Lee
6,424,311 B1 7/2002 Tsai et al.
6,442,507 B1 8/2002 Skimore et al.
6,445,688 B1 9/2002 Garces et al.
6,452,556 B1 9/2002 Ha et al.
6,452,981 B1 9/2002 Raleigh
6,456,242 B1 9/2002 Crawford
6,493,679 B1 12/2002 Rappapport et al.
6,496,083 B1 12/2002 Kushitani et al.
6,498,589 B1 12/2002 Horii
6,499,006 B1 12/2002 Rappaport et al.
6,507,321 B2 1/2003 Oberschmidt et al.
6,531,985 B1 3/2003 Jones et al.
6,583,765 B1 6/2003 Schamberger et al.
6,586,786 B2 7/2003 Kitazawa et al.
6,606,059 B1 8/2003 Barabash
6,611,230 B2 8/2003 Phelan
6,621,464 B1 9/2003 Fang
6,625,454 B1 9/2003 Rappaport et al.
6,633,206 B1 10/2003 Kato
6,642,889 B1 11/2003 McGrath
6,674,459 B2 1/2004 Ben-Shachar et al.
6,701,522 B1 3/2004 Rubin et al.
6,720,925 B2 4/2004 Wong et al.
6,724,346 B2 4/2004 Le Bolzer
6,725,281 B1 4/2004 Zintel et al.
6,741,219 B2 5/2004 Shor
6,747,605 B2 6/2004 Lebaric
6,753,814 B2 6/2004 Killen et al.
6,753,826 B2 6/2004 Chiang et al.
6,762,723 B2 7/2004 Nallo et al.
6,774,846 B2 8/2004 Fullerton et al.
6,779,004 B1 8/2004 Zintel
6,786,769 B2 9/2004 Lai
6,801,790 B2 10/2004 Rudrapatna
6,819,287 B2 11/2004 Sullivan et al.
6,839,038 B2 1/2005 Weinstein
6,859,176 B2 2/2005 Choi
6,859,182 B2 2/2005 Horii
6,876,280 B2 4/2005 Nakano
6,876,836 B2 4/2005 Lin et al.
6,888,504 B2 5/2005 Chiang et al.
6,888,893 B2 5/2005 Li et al.
6,892,230 B1 5/2005 Gu et al.
6,903,686 B2 6/2005 Vance et al.
6,906,678 B2 6/2005 Chen
6,910,068 B2 6/2005 Zintel et al.
6,914,581 B1 7/2005 Popek
6,924,768 B2 8/2005 Wu et al.
6,931,429 B2 8/2005 Gouge et al.
6,937,206 B2 8/2005 Puente Ballarda et al.
6,941,143 B2 9/2005 Mathur
6,943,749 B2 9/2005 Paun
6,946,996 B2 9/2005 Koyama
6,950,019 B2 9/2005 Bellone et al.
6,950,069 B2 9/2005 Gaucher et al.
6,961,026 B2 11/2005 Toda
6,961,028 B2 11/2005 Joy et al.
6,965,353 B2 11/2005 Shirosaka et al.
6,973,622 B1 12/2005 Rappaport et al.
6,975,834 B1 12/2005 Forster
6,980,782 B1 12/2005 Braun et al.
7,023,909 B1 4/2006 Adams et al.
7,034,769 B2 4/2006 Surducan et al.
7,034,770 B2 4/2006 Yang et al.
7,039,363 B1 5/2006 Kasapi et al.
7,043,277 B1 5/2006 Pfister
7,050,809 B2 5/2006 Lim
7,053,844 B2 5/2006 Gaucher et al.
7,053,845 B1 5/2006 Holloway et al.
7,064,717 B2 6/2006 Kaluzni et al.
7,068,234 B2 6/2006 Sievenpiper
7,075,485 B2 7/2006 Song et al.
7,084,816 B2 8/2006 Watanabe
7,084,823 B2 8/2006 Caimi et al.
7,085,814 B1 8/2006 Ghandhi et al.

(56) References Cited

U.S. PATENT DOCUMENTS 7,088,299 B2 8/2006 Siegler et al.
7,089,307 B2 8/2006 Zintel et al.
7,130,895 B2 10/2006 Zintel et al.
7,171,475 B2 1/2007 Weisman et al.
7,193,562 B2 3/2007 Shtrom et al.
7,196,674 B2 3/2007 Timofeev et al.
7,277,063 B2 10/2007 Shirosaka et al.
7,308,047 B2 12/2007 Sadowsky
7,312,762 B2 12/2007 Puente Ballarda et al.
7,319,432 B2 1/2008 Andersson
7,327,328 B2 2/2008 Yoneya et al.
7,362,280 B2 4/2008 Shtrom et al.
7,375,694 B2 * 5/2008 Jung ..... H01Q 1/243 343/700 MS
7,388,552 B2 6/2008 Mori
7,424,298 B2 9/2008 Lastinger et al.
7,493,143 B2 2/2009 Jalali
7,498,996 B2 3/2009 Shtrom et al.
7,525,486 B2 4/2009 Shtrom et al.
7,603,141 B2 10/2009 Dravida
7,609,223 B2 10/2009 Manasson et al.
7,646,343 B2 1/2010 Shtrom et al.
7,652,632 B2 1/2010 Shtrom et al.
7,675,474 B2 3/2010 Shtrom et al.
7,696,940 B1 4/2010 Macdonald
7,696,943 B2 4/2010 Chiang et al.
7,696,948 B2 4/2010 Abramov et al.
7,868,842 B2 1/2011 Chair
7,880,683 B2 2/2011 Shtrom et al.
7,899,497 B2 3/2011 Kish et al.
7,965,252 B2 6/2011 Shtrom et al.
8,031,129 B2 10/2011 Shtrom et al.
8,199,063 B2 6/2012 Moon et al.
8,314,749 B2 11/2012 Shtrom et al.
8,698,675 B2 4/2014 Shtrom et al.
8,860,629 B2 10/2014 Shtrom et al.
2001/0046848 A1 11/2001 Kenkel
2002/0031130 A1 3/2002 Tsuchiya et al.
2002/0047800 A1 4/2002 Proctor, Jr. et al.
2002/0054580 A1 5/2002 Strich et al.
2002/0080767 A1 6/2002 Lee
2002/0084942 A1 7/2002 Tsai et al.
2002/0101377 A1 8/2002 Crawford
2002/0105471 A1 8/2002 Kojima et al.
2002/0112058 A1 8/2002 Weisman et al.
2002/0140607 A1 10/2002 Zhou
2002/0158798 A1 10/2002 Chiang et al.
2002/0170064 A1 11/2002 Monroe et al.
2003/0026240 A1 2/2003 Eyuboglu et al.
2003/0030588 A1 2/2003 Kalis et al.
2003/0063591 A1 4/2003 Leung et al.
2003/0076264 A1 * 4/2003 Yuanzhu ..... H01Q 1/38 343/700 MS
2003/0122714 A1 7/2003 Wannagot et al.
2003/0169330 A1 9/2003 Ben-Shachar et al.
2003/0184490 A1 10/2003 Raiman et al.
2003/0189514 A1 10/2003 Miyano et al.
2003/0189521 A1 10/2003 Yamamoto et al.
2003/0189523 A1 10/2003 Ojantakanen et al.
2003/0210207 A1 11/2003 Suh et al.
2003/0227414 A1 12/2003 Saliga et al.
2003/0231138 A1 12/2003 Weinstein
2004/0014432 A1 1/2004 Boyle
2004/0017310 A1 1/2004 Runkle et al.
2004/0017315 A1 1/2004 Fang et al.
2004/0017860 A1 1/2004 Liu
2004/0027291 A1 2/2004 Zhang et al.
2004/0027304 A1 2/2004 Chiang et al.
2004/0032378 A1 2/2004 Volman et al.
2004/0036651 A1 2/2004 Toda
2004/0036654 A1 2/2004 Hsieh
2004/0041732 A1 3/2004 Aikawa et al.
2004/0048593 A1 3/2004 Sano
2004/0058690 A1 3/2004 Ratzel et al.
2004/0061653 A1 4/2004 Webb et al.
2004/0070543 A1 4/2004 Masaki
2004/0075609 A1 4/2004 Li
2004/0080455 A1 4/2004 Lee
2004/0095278 A1 5/2004 Kanemoto et al.
2004/0114535 A1 6/2004 Hoffman et al.
2004/0125777 A1 7/2004 Doyle et al.
2004/0145528 A1 7/2004 Mukai et al.
2004/0150567 A1 * 8/2004 Yuanzhu ..... H01Q 1/3291 343/700 MS
2004/0160376 A1 8/2004 Hornsby et al.
2004/0183727 A1 9/2004 Choi
2004/0190477 A1 9/2004 Olson et al.
2004/0203347 A1 10/2004 Nguyen
2004/0239571 A1 12/2004 Papziner et al.
2004/0260800 A1 12/2004 Gu et al.
2005/0001777 A1 1/2005 Suganthan et al.
2005/0022210 A1 1/2005 Zintel et al.
2005/0041739 A1 2/2005 Li et al.
2005/0042988 A1 2/2005 Hoek et al.
2005/0048934 A1 3/2005 Rawnick et al.
2005/0074018 A1 4/2005 Zintel et al.
2005/0074108 A1 4/2005 Dezonno et al.
2005/0083236 A1 4/2005 Louzir et al.
2005/0097503 A1 5/2005 Zintel et al.
2005/0105632 A1 5/2005 Catreux-Erces et al.
2005/0128983 A1 6/2005 Kim et al.
2005/0135480 A1 6/2005 Li et al.
2005/0138137 A1 6/2005 Encarnacion et al.
2005/0138193 A1 6/2005 Encarnacion et al.
2005/0146475 A1 7/2005 Bettner et al.
2005/0180381 A1 8/2005 Retzer et al.
2005/0188193 A1 8/2005 Kuehnel et al.
2005/0200529 A1 9/2005 Watanabe
2005/0219128 A1 10/2005 Tan et al.
2005/0240665 A1 10/2005 Gu et al.
2005/0266902 A1 12/2005 Khatri
2005/0267935 A1 12/2005 Ghandhi et al.
2006/0007891 A1 1/2006 Aoki et al.
2006/0038734 A1 2/2006 Shtrom et al.
2006/0050005 A1 3/2006 Shirosaka et al.
2006/0078066 A1 4/2006 Yun
2006/0094371 A1 5/2006 Nguyen
2006/0098607 A1 5/2006 Zeng et al.
2006/0109191 A1 5/2006 Shtrom et al.
2006/0123124 A1 6/2006 Weisman et al.
2006/0123125 A1 6/2006 Weisman et al.
2006/0123455 A1 6/2006 Pai et al.
2006/0160495 A1 7/2006 Strong
2006/0168159 A1 7/2006 Weisman et al.
2006/0184660 A1 8/2006 Rao et al.
2006/0184661 A1 8/2006 Weisman et al.
2006/0184693 A1 8/2006 Rao et al.
2006/0187660 A1 8/2006 Liu
2006/0224690 A1 10/2006 Falkenburg et al.
2006/0225107 A1 10/2006 Seetharaman et al.
2006/0227761 A1 10/2006 Scott, III et al.
2006/0239369 A1 10/2006 Lee
2006/0262015 A1 11/2006 Thornell-Pers et al.
2006/0291434 A1 12/2006 Gu et al.
2007/0027622 A1 2/2007 Cleron et al.
2007/0030210 A1 2/2007 Shibata
2007/0135167 A1 6/2007 Liu
2007/0162819 A1 7/2007 Kawamoto
2008/0062063 A1 3/2008 Matsushita et al.
2008/0129630 A1 * 6/2008 Baliarda ..... H01Q 1/36 343/793
2008/0266189 A1 10/2008 Wu et al.
2008/0284657 A1 * 11/2008 Rudant ..... H01Q 1/36 343/700 MS
2009/0075606 A1 3/2009 Shtrom et al.
2010/0289705 A1 11/2010 Shtrom et al.
2011/0205137 A1 8/2011 Shtrom et al.
2012/0007790 A1 1/2012 Shtrom et al.
2012/0068892 A1 3/2012 Shtrom et al.
2012/0249393 A1 * 10/2012 Hotta ..... H01Q 1/243 343/843
2013/0181882 A1 7/2013 Shtrom et al.

(56) References Cited

U.S. PATENT DOCUMENTS

| | | | |
|---|---|---|---|
| 2014/0071013 | A1 | 3/2014 | Shtrom et al. |
| 2014/0225807 | A1 | 8/2014 | Shtrom et al. |

FOREIGN PATENT DOCUMENTS

| | | | |
|---|---|---|---|
| EP | 2 479 837 | | 7/2012 |
| EP | 2 619 848 | | 7/2013 |
| EP | 2 893 593 | | 7/2015 |
| HK | 1180836 | A | 10/2013 |
| JP | 2003-038933 | | 2/1991 |
| JP | 2008-088633 | | 2/1996 |
| JP | 2011-215040 | | 8/1999 |
| JP | 2001-057560 | | 2/2002 |
| JP | 2005-244302 | | 9/2005 |
| JP | 2005-354249 | | 12/2005 |
| JP | 2006-060408 | | 3/2006 |
| TW | I372487 | | 9/2012 |
| TW | I451624 | | 9/2014 |
| WO | WO 90/004893 | | 5/1990 |
| WO | WO 02/025967 | | 3/2002 |
| WO | WO 03/079484 | | 9/2003 |
| WO | WO 2006/023247 | | 3/2006 |
| WO | WO 2007/127087 | | 11/2007 |
| WO | WO 2007/127088 | | 11/2007 |
| WO | WO 2010/086587 | A1 | 8/2010 |
| WO | WO 2012/040397 | | 3/2012 |
| WO | WO 2014/039949 | | 3/2014 |
| WO | WO 2014/146038 | | 9/2014 |

OTHER PUBLICATIONS

Chinese Patent Application No. 201210330398.6, Second Office Action dated Sep. 24, 2014.

U.S. Appl. No. 13/607,612, Office Action dated Nov. 7, 2014.

U.S. Appl. No. 13/607,612, Final Office Action dated Mar. 19, 2015.

Chinese Patent Application No. 201210330398.6, Third Office Action dated Jun. 2, 2015.

"Authorization of spread spectrum and other wideband emissions not presently provided for in the FCC Rules and Regulations," Before the Federal Communications Commission, FCC 81-289, 87 F.C.C.2d 876, Jun. 30, 1981.

"Authorization of Spread Spectrum Systems Under Parts 15 and 90 of the FCC Rules and Regulations," Rules and Regulations Federal Communications Commission, 47 CFR Part 2, 15, and 90, Jun. 18, 1985.

Alard, M., et al., "Principles of Modulation and Channel Coding for Digital Broadcasting for Mobile Receivers," 8301 EBU Review Technical, Aug. 1987, No. 224, Brussels, Belgium.

Ando et al., "Study of Dual-Polarized Omni-Directional Antennas for 5.2 GHz-Band 2×2 MIMO-OFDM Systems," Antennas and Propogation Society International Symposium, 2004, IEEE, pp. 1740-1743, vol. 2.

Areg Alimian et al., "Analysis of Roaming Techniques," doc.:IEEE 802.11-04/0377r1, Submission, Mar. 2004.

Bedell, Paul "Wireless Crash Course," 2005, p. 84, The McGraw-Hill Companies, Inc., USA.

Behdad et al., Slot Antenna Miniaturization Using Distributed Inductive Loading, Antenna and Propagation Society International Symposium, 2003 IEEE, vol. 1, pp. 308-311 (Jun. 2003).

Berenguer, Inaki, et al., "Adaptive MIMO Antenna Selection," Nov. 2003.

Casas, Eduardo F., et al., "OFDM for Data Communication Over Mobile Radio FM Channels—Part I: Analysis and Experimental Results," IEEE Transactions on Communications, vol. 39, No. 5, May 1991, pp. 783-793.

Casas, Eduardo F., et al., "OFDM for Data Communication Over Mobile Radio FM Channels-Part II: Performance Improvement," Department of Electrical Engineering, University of British Colombia, 1996.

Chang, Nicholas B. et al., "Optimal Channel Probing and Transmission Scheduling for Opportunistics Spectrum Access," Sep. 2007.

Chang, Robert W., "Synthesis of Band-Limited Orthogonal Signals for Mutichannel Data Transmission," The Bell System Technical Journal, Dec. 1966, pp. 1775-1796.

Chang, Robert W., et al., "A Theoretical Study of Performance of an Orthogonal Multiplexing Data Transmission Scheme," IEEE Transactions on Communication Technology, vol. Com-16, No. 4, Aug. 1968, pp. 529-540.

Chuang et al., A 2.4 GHz Polarization-diversity Planar Printed Dipole Antenna for WLAN and Wireless Communication Applications, Microwave Journal, vol. 45, No. 6, pp. 50-62 (Jun. 2002).

Cimini, Jr., Leonard J, "Analysis and Simulation of a Digital Mobile Channel Using Orthogonal Frequency Division Multiplexing," IEEE Transactions on Communications, vol. Com-33, No. 7, Jul. 1985, pp. 665-675.

Cisco Systems, "Cisco Aironet Access Point Software Configuration Guide: Configuring Filters and Quality of Service," Aug. 2003.

Dell Inc., "How Much Broadcast and Multicast Traffic Should I Allow in My Network," PowerConnect Application Note #5, Nov. 2003.

Dunkels, Adam et al., "Connecting Wireless Sensornets with TCP/IP Networks," Proc. of the 2d Int'l Conf. on Wired Networks, Frankfurt, Feb. 2004.

Dunkels, Adam et al., "Making TCP/IP Viable for Wireless Sensor Networks," Proc. of the 1st Euro. Workshop on Wireless Sensor Networks, Berlin, Jan. 2004.

Dutta, Ashutosh et al., "MarconiNet Supporting Streaming Media Over Localized Wireless Multicast," Proc. of the 2d Int'l Workshop on Mobile Commerce, 2002.

English Translation of PCT Pub. No. WO2004/051798 (as filed U.S. Appl. No. 10/536,547).

Festag, Andreas, "What is MOMBASA?" Telecommunication Networks Group (TKN), Technical University of Berlin, Mar. 7, 2002.

Frederick et al., Smart Antennas Based on Spatial Multiplexing of Local Elements (SMILE) for Mutual Coupling Reduction, IEEE Transactions of Antennas and Propogation, vol. 52., No. 1, pp. 106-114 (Jan. 2004).

Gaur, Sudhanshu, et al., "Transmit/Receive Antenna Selection for MIMO Systems to Improve Error Performance of Linear Receivers," School of ECE, Georgia Institute of Technology, Apr. 4, 2005.

Gledhill, J. J., et al., "The Transmission of Digital Television in the UHF Band Using Orthogonal Frequency Division Multiplexing," Sixth International Conference on Digital Processing of Signals in Communications, Sep. 2-6, 1991, pp. 175-180.

Golmie, Nada, "Coexistence in Wireless Networks: Challenges and System-Level Solutions in the Unlicensed Bands," Cambridge University Press, 2006.

Hewlett Packard, "HP ProCurve Networking: Enterprise Wireless LAN Networking and Mobility Solutions," 2003.

Hirayama, Koji et al., "Next-Generation Mobile-Access IP Network," Hitachi Review vol. 49, No. 4, 2000.

Ian R. Akyildiz, et al., "A Virtual Topology Based Routing Protocol for Multihop Dynamic Wireless Networks," Broadband and Wireless Networking Lab, School of Electrical and Computer Engineering, Georgia Institute of Technology, 2001.

Information Society Technologies Ultrawaves, "System Concept / Architecture Design and Communication Stack Requirement Document," Feb. 23, 2004.

Ken Tang, et al., "MAC Layer Broadcast Support in 802.11 Wireless Networks," Computer Science Department, University of California, Los Angeles, 2000 IEEE, pp. 544-548.

Ken Tang, et al., "MAC Reliable Broadcast in Ad Hoc Networks," Computer Science Department, University of California, Los Angeles, 2001 IEEE, pp. 1008-1013.

Mawa, Rakesh, "Power Control in 3G Systems," Hughes Systique Corporation, Jun. 28, 2006.

Microsoft Corporation, "IEEE 802.11 Networks and Windows XP," Windows Hardware Developer Central, Dec. 4, 2001.

Molisch, Andreas F., et al., "MIMO Systems with Antenna Selection—an Overview," Draft, Dec. 31, 2003.

(56) References Cited

OTHER PUBLICATIONS

Moose, Paul H., "Differential Modulation and Demodulation of Multi-Frequency Digital Communications Signals," 1990 IEEE, CH2831-6/90/0000-0273.
Pat Calhoun et al., "802.11 r strengthens wireless voice," Technology Update, Network World, Aug. 22, 2005, http://www.networkworld.com/news/tech/2005/082208techupdate.html.
Press Release, NETGEAR RangeMax(TM) Wireless Networking Solutions Incorporate Smart MIMO Technology to Eliminate Wireless Dead Spots and Take Consumers Farther, Ruckus Wireles Inc. (Mar. 7, 2005), available at http://ruckuswireless.com/press/releases/20050307.php.
RL Miller, "4.3 Project X—A True Secrecy System for Speech," Engineering and Science in the Bell System, a History of Engineering and Science in the Bell System National Service in War and Peace (1925-1975), pp. 296-317, 1978, Bell Telephone Laboratories, Inc.
Sadek, Mirette, et al., "Active Antenna Selection in Multiuser MIMO Communications," IEEE Transactions on Signal Processing, vol. 55, No. 4, Apr. 2007, pp. 1498-1510.
Saltzberg, Burton R., "Performance of an Efficient Parallel Data Transmission System," IEEE Transactions on Communication Technology, vol. Com-15, No. 6, Dec. 1967, pp. 805-811.
Siemens, Carrier Lifetime and Forward Resistance in RF PIN Diodes. 1997. [retrieved on Dec. 1, 2013]. Retrieved from the Internet: <URL:http://palgong.kyungpook.ac.kr/~ysyoon/Pdf/appli034.pdf>.
Steger, Christopher et al., "Performance of IEEE 802.11b Wireless LAN in an Emulated Mobile Channel," 2003.
Toskala, Antti, "Enhancement of Broadcast and Introduction of Multicast Capabilities in RAN," Nokia Networks, Palm Springs, California, Mar. 13-16, 2001.
Tsunekawa, Kouichi "Diversity Antennas for Portable Telephones," 39th IEEE Vehicular Technology, May 1-3, 1989, San Francisco, CA.
Varnes et al., A Switched Radial Divider for an L-Band Mobile Satellite Antenna, European Microwave Conference (Oct. 1995), pp. 1037-1041.
Vincent D. Park, et al., "A Performance Comparison of the Temporally-Ordered Routing Algorithm and Ideal Link-State Routing," IEEE, Jul. 1998, pp. 592-598.
W.E. Doherty, Jr. et al., The Pin Diode Circuit Designer's Handbook 1998.
Weinstein, S. B., et al., "Data Transmission by Frequency-Division Multiplexing Using the Discrete Fourier Transform," IEEE Transactions on Communication Technology, vol. Com-19, No. 5, Oct. 1971, pp. 628-634.
Wennstrom, Mattias et al., "Transmit Antenna Diversity in Ricean Fading MIMO Channels with Co-Channel Interference," 2001.
Petition Decision Denying Request to Order Additional Claims for U.S. Pat. No. 7,193,562 (Control No. 95/001078) mailed on Jul. 10, 2009.
Right of Appeal Notice for U.S. Pat. No. 7,193,562 (Control No. 95/001078) mailed on Jul. 10, 2009.
Supplementary Eurpean Search Report for EP Application No. 07755519 dated Mar. 11, 2009.
European Application No. 7775498.4 Examination Report dated Mar. 12, 2013.
European Application No. 7775498.4 Examination Report dated Oct. 17, 2011.
Chinese Patent Application No. 200780023325.X, Second Office Action dated Oct. 19, 2012.
Chinese Patent Application No. 200780023325.X, First Office Action dated Feb. 13, 2012.
Chinese Patent Application No. 200780020943.9, Second Office Action dated Aug. 29, 2012.
Chinese Patent Application No. 201180050872.3, First Office Action dated May 30, 2014.
Chinese Patent Application No. 201210330398.6, First Office Action dated Feb. 20, 2014.
Taiwan Patent Application No. 096114271, Office Action dated Dec. 18, 2013.
Taiwan Patent Application No. 096114265, Office Action dated Jun. 20, 2011.
PCT/US07/09278, PCT International Search Report and Written Opinion dated Aug. 18, 2008.
PCT/US11/052661, PCT International Search Report and Written Opinion dated Jan. 17, 2012.
PCT/US07/009276, PCT International Search Report and Written Opinion dated Aug. 11, 2008.
PCT/US13/058713, PCT International Search Report and Written Opinion dated Dec. 13, 2013.
PCT/US14/030911, PCT International Search Report and Written Opinion dated Aug. 22, 2014.
U.S. Appl. No. 11/413,670, Final Office Action dated Jul. 13, 2009.
U.S. Appl. No. 11/413,670, Office Action dated Jan. 6, 2009.
U.S. Appl. No. 11/413,670, Final Office Action dated Aug. 11, 2008.
U.S. Appl. No. 11/413,670, Office Action dated Feb. 4, 2008.
U.S. Appl. No. 11/414,117, Final Office Action dated Jul. 6, 2009.
U.S. Appl. No. 11/414,117, Office Action dated Sep. 25, 2008.
U.S. Appl. No. 11/414,117, Office Action dated Mar. 21, 2008.
U.S. Appl. No. 12/605,256, Office Action dated Dec. 28, 2010.
U.S. Appl. No. 13/240,687, Office Action dated Feb. 22, 2012.
U.S. Appl. No. 13/681,421, Office Action dated Dec. 3, 2013.
U.S. Appl. No. 12/545,758, Final Office Action dated Sep. 10, 2013.
U.S. Appl. No. 12/545,758, Office Action dated Jan. 2, 2013.
U.S. Appl. No. 12/545,758, Final Office Action dated Oct. 3, 2012.
U.S. Appl. No. 12/545,758, Office Action dated Oct. 3, 2012.
U.S. Appl. No. 12/887,448, Office Action dated Apr. 28, 2014.
U.S. Appl. No. 12/887,448, Final Office Action dated Jan. 14, 2014.
U.S. Appl. No. 12/887,448, Office Action dated Sep. 26, 2013.
U.S. Appl. No. 12/887,448, Final Office Action dated Jul. 2, 2013.
U.S. Appl. No. 12/887,448, Office Action dated Jan. 7, 2013.
Chinese Patent Application No. 201180050872.3, Second Office Action dated Jan. 30, 2015.
U.S. Appl. No. 12/887,448, Final Office Action dated Feb. 10, 2015.
U.S. Appl. No. 13/607,612, Office Action dated Sep. 3, 2015.
Chinese Patent Application No. 201180050872.3, Third Office Action dated Aug. 4, 2015.
Chinese Patent Application No. 201210330398.6, Fourth Office Action dated Sep. 17, 2015.
SIPO Office Action for related Chinese Application No. 201210330398.6, dated Jan. 4, 2016 (12 sheets).
SIPO Notification of Grant for related Chinese Application No. 201180050872.3, dated Jan. 11, 2016 (4 sheets).
Notice of Allowance for co-pending U.S. Appl. No. 12/887,448, dated Mar. 28, 2016 (15 sheets).
SIPO Notification of Grant for related Chinese Application No. 201210330398.6, dated Apr. 7, 2016 (4 sheets).
Notice of Allowance for co-pending U.S. Appl. No. 14/252,857, dated Apr. 13, 2016 (8 sheets).
Office Action for co-pending U.S. Appl. No. 13/607,612, dated May 5, 2016 (10 sheets).
Balanis "Modern Antenna Handbook," John Wiley & Sons, Inc., 2008, pp. 72-77.
Neelakanta, et al. "Antennas for Information Super Skyways: An Exposition on Outdoor and Indoor Wireless Antennas," Electronic and Electrical Engineering Research Studies. Antennas series; 12. 2003, pp. 297, 326-329.
Saunders, et al. "Antennas and Propagation for Wireless Communication Systems: Second Edition," Wiley and Sons Ltd., 2007, pp. 78-79.
Thiel, et al. "Switched Parasitic Antennas for Cellular Communications," Artech House antennas and propagation library, Jan. 2002, pp. 52-55.
Othman, et al., "*Dual and Wide-Band Inductively-Loaded Dipole-Based Antennas for WLAN/UMTS Applications*", IEEE Transactions on Antennas and Propagation, vol. 61, No. 3, Mar. 2013, pp. 1430-1435.
Jahanbakhshi, et al., "*Design and Simulation of Different Types of Meander Line Antennas with Improved Efficiency*", Progress in Eiectromagnetics Research Symposium Proceedings (PIERS), Moscow, Russia, Aug. 19-23, 2012, pp. 594-597.

(56) References Cited

OTHER PUBLICATIONS

Extended European Search Report for related European Application No. 14764406.6, dated Oct. 12, 2016 (12 pages).
Extended European Search Report for co-pending European Application No. 13834691.1, dated Apr. 6, 2016 (7 pages).
Othman, Mohamed A. "Dual and Wide-Band Inductively-Loaded Dipole-Based Antennas for WLAN/UMTS Applications", IEEE Transactions on Antennas and Propagation, vol. 61, No. 3, Mar. 2013, pp. 1430-1435.
SIPO Office Action for related Chinese Application No. 201480015806.6, dated May 10, 2018 and English Translation (11 pages).

* cited by examiner

LOW-BAND REFLECTOR FOR DUAL BAND DIRECTIONAL ANTENNA

CROSS-REFERENCE TO RELATED APPLICATIONS

This application claims the priority of U.S. provisional application No. 61/800,854 filed Mar. 15, 2013. The disclosures of the aforementioned application is incorporated herein by reference.

BACKGROUND OF THE INVENTION

Field of the Invention

The present invention generally relates to dual band directional antennas. The present invention more specifically relates to reflector switching between high-band and low-band patterns.

Description of the Related Art

Antennas that provide dual band coverage (for example, 2.4 GHz and 5.0 GHz) with a single feed are common. Attempting to form a directional pattern in one of the frequency bands using commonly available antennas with reflecting parasitic elements, however, will often cause unwanted changes in the patterns of the other band. Such changes complicate simultaneous operation in both frequency bands.

More specifically, changes in lower frequency band reflectors are prone to affect patterns in the higher frequency band patterns. Changes in the high frequency band reflectors typically will not affect low frequency band patterns because high frequency band reflectors are shorter with respect to the low-band wavelength. As a result, the band patterns of the lower frequencies are not affected. This is true, however, only when the frequency ratio between the high frequency band and low frequency band is sufficiently large (e.g., a frequency ratio of 2:1 or greater). When the frequency ratio between the high frequency band and low frequency band is not large enough (e.g., less than 2:1), the high frequency band may interfere with low frequency band operations.

There is a need in the art for dual band directional antennas that allow for simultaneous operation in high and low frequency bands. More specifically, there is a need for dual band directional antennas with low frequency band reflectors that form desired patterns in low frequency while remaining transparent to high frequency bands such that patterns in the high frequency are not otherwise adversely affected.

SUMMARY OF THE INVENTION

Embodiments of the present invention provide for a dual band directional antenna with low frequency band reflectors that form desired antenna patterns in a low frequency band while remaining transparent to a higher frequency band. As a result of such frequency transparency, pattern changes in the lower frequency bands do not affect patterns in the higher band frequencies. As used herein, transparency, with respect to a reflector, refers to a reflector in one band (e.g., the low-band) that is invisible to or will not otherwise affect the pattern of another frequency band (e.g., the high-band).

Embodiments of the present invention use low frequency reflectors rather than ground plane slots or otherwise inefficient reflectors such as inductively tuned short reflectors. Embodiments of the presently disclosed antenna system allow for two-band independent pattern steering with minimized hardware costs and without sacrificing peak gain, front-to-back ratio, or pattern bandwidth in either band. The use of a dual band array, as opposed to two separate smart antenna systems, may result in reduced size and hardware costs. Additional radio chains may also be supported in a given radio frequency (RF) environment.

DETAILED DESCRIPTION

Embodiments of the present invention involve the use of reflectors for dual band directional antennas in the low frequency band such that the reflectors form desired patterns yet remain transparent in the high frequency band thereby avoiding unwanted or otherwise undesirable changes to patterns in that band.

While reference is made to operation in the 2.4 GHz and 5.0 GHz range, these references are exemplary with respect to the operation of a dual band antenna. It will be understood that the dual band directional antennas described herein may operate in any suitable frequency bands, which may include the 2.4 GHz or 5.0 GHz frequency bands or any other suitable frequency bands. Embodiments of the present invention allow for a dual-band directional antenna with a dual-band driven element and switched high-band and low-band reflectors to be switched on or off as to the low-band reflectors without disturbing the high-band patterns.

In some embodiments, a directional antenna system includes a dual band driven element, a high-band reflector positioned relative the dual band driven element, and a low-band reflector element positioned relative the dual band driven element. The low-band reflector element may include a meander line, for example, meander line 100 of FIG. 1 or meander line 200 of FIG. 2, as described below.

Figure 1:
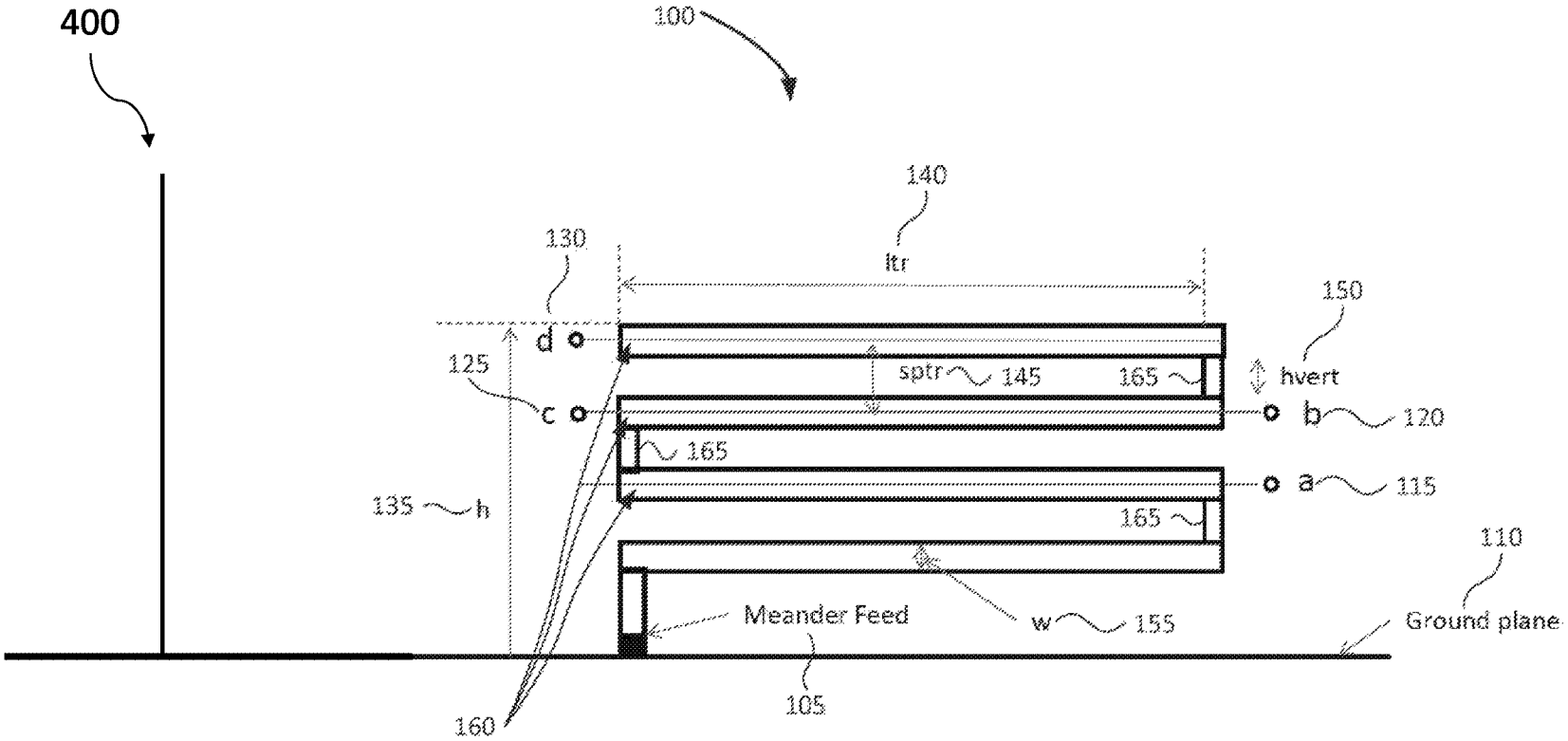
FIG. 1 illustrates an exemplary meander line reflector.

FIG. 1 illustrates an exemplary meander line 100 and a high-band reflector element 400 positioned relative the meander line 100 of the low-band reflector element. In some embodiments, meander line 100 may be implemented as a trace on a dielectric substrate, on a printed circuit board (PCB), as a sheet metal part, or can be constructed from wires or bent tubing such as a copper conductor. Meander line 100 includes meander feed-105, transmission lines 160 connected by vertical sections 165 of height hvert 150, and ground plane 110. In some embodiments, meander line 100 may be implemented in a low-band reflector element of a directional antenna system.

Reflectors for directional antennas over a ground plane (i.e., ground plane 110) are usually in the order of $\lambda/4$ in height, where $\lambda$ denotes wavelength. In some embodiments, meander line 100 (i.e., low-band reflector with meander line 100) is implemented when there are restrictions on reflector height. For example, the available height h, shown as 135, may be less than $\lambda/4$. Thus, a meander line may allow for implementation of the dual band directional antenna in space-constrictive form factors, especially with regard to restrictions on height h 135. In some embodiments, a specifically configured meander line reflector 100 may be specifically configured so that it may be used to shorten the low-band reflector while simultaneously making it transparent to high-band frequencies.

Figure 2:
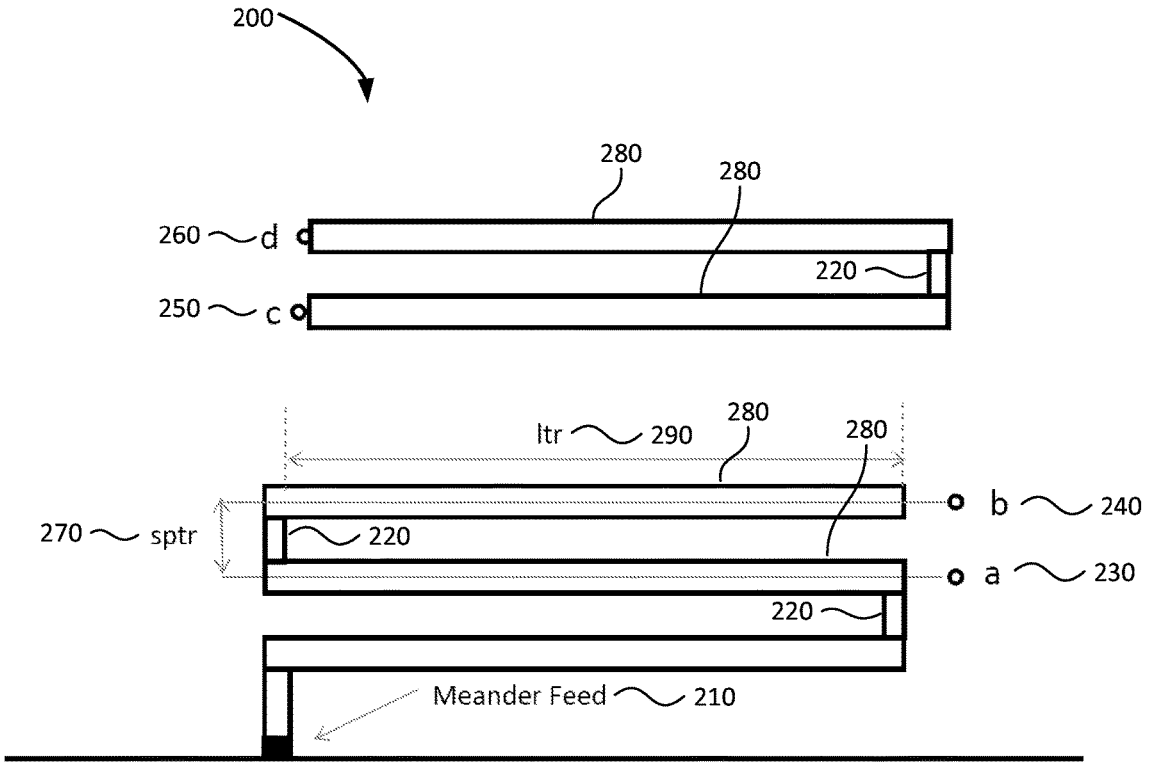
FIG. 2 illustrates an exemplary meander line reflector including a plurality of stacked horizontal transmission lines.

FIG. 2 illustrates meander line 200. In some embodiments, meander line 200 is similar to meander line 100 of FIG. 1. Meander line 200 includes meander feed 210. Meander line 200 includes horizontally stacked, short circuited transmission lines 280, which are connected by short vertical sections 220, each having a vertical height denoted hvert, shown, for example, in FIG. 1 as 150. The reactance seen between points "a" and "b" and then "c" and "d," shown as 230, 240, 250, and 260 in FIG. 2 (also shown as 115, 120, 125, and 130 in FIG. 1) is given by Equation 1:

$$X_n = Z0 \cdot \tan(2\pi ltr/\lambda), \quad (1)$$

where ltr denotes electrical length of the transmission line 290, λ denotes wavelength, and $X_n$, denotes the reactance of the nth transmission line at the frequency, F. The frequency F is given by F=c/λ, wherein c denotes velocity of propagation in the transmission media.

The wavelength λ varies as a function of the frequency F, as illustrated in Equations 2a and 2b:

$$\lambda high = c/F_{high} \quad (2a)$$

$$\lambda low = c/F_{low} \quad (2b)$$

As used herein, Z0 denotes the characteristic impedance of the transmission line. Z0 is a function of the parameters w, shown as 155 in FIG. 1, and sptr, shown as 145 in FIGS. 1 and 270 in FIG. 2, and the dielectric constant of the material in which the low-band reflector element including meander line 200 is immersed.

Figure 3:
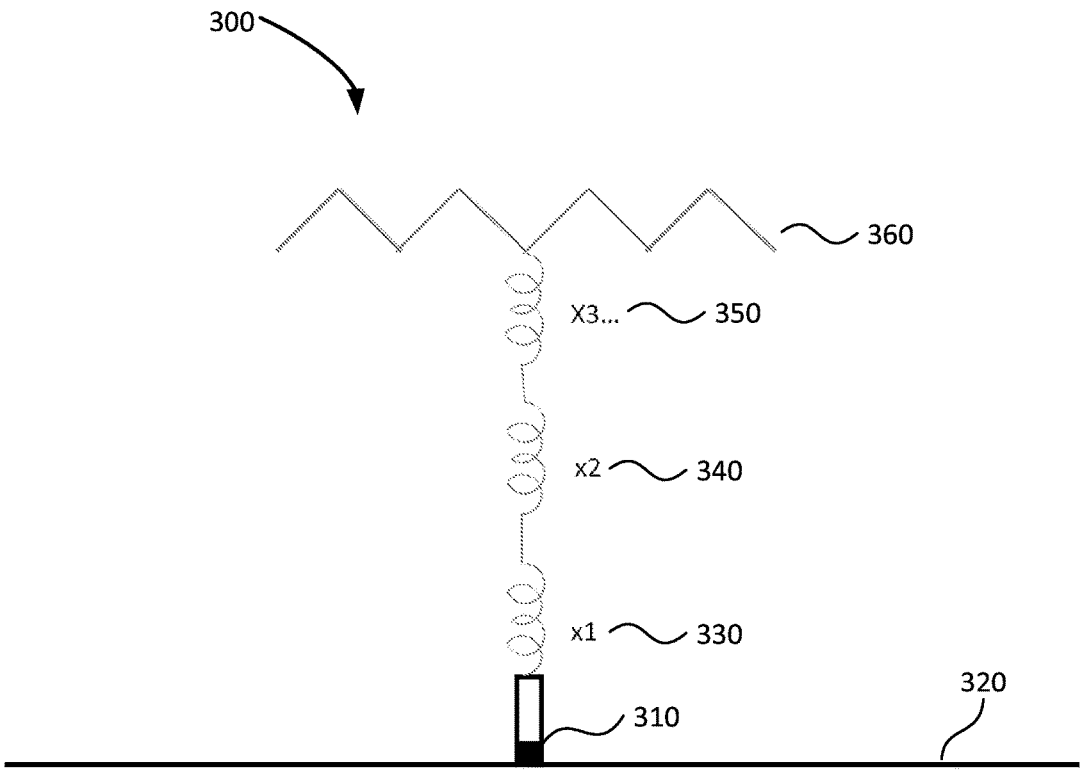
FIG. 3 illustrates an exemplary equivalent circuit as used in a meander line reflector.

FIG. 3 illustrates an exemplary equivalent circuit 300 for use in a meander line. In some embodiments, equivalent circuit 300 may be implemented with the meander line 100 of FIG. 1 or the meander line 200 of FIG. 2. Equivalent circuit 300 includes feed 310 and ground plane 320. Equivalent circuit 300 is illustrated as including resistor 360 and any number of inductors, with exemplary inductors "x1," "x2," and "x3" respectively shown as 330, 340, and 350. The value of the reactance of the nth transmission line $X_n$, may differ at high-band and low-band frequencies. In order to make the reflector transparent at the high-band, the electrical length of the transmission line, ltr, (e.g., ltr 290 of FIG. 2 and ltr 140 of FIG. 1) may be adjusted according to Equation 3:

$$2\pi ltr/\pi high = 90 \quad (3)$$

Adjusting the length of the transmission line according to Equation 3 results in a very large reactance $X_n$, if not theoretically infinite. No current flows in the reflector, and as a result, the reflector is transparent to high-band radiation. At the low-band, $X_n$ is given by Equation 1 with λ=λlow, as defined in Equation 2b. By adjusting the number of sections and the parameter hvert, shown s 150 in FIG. 1, the reflector can be tuned to resonance in the low-band.

While the foregoing reflector implementation is described as a single instance, multiple reflectors may be implemented to create an array of the same. For example, a dual band driven element may be positioned relative a 2 GHz and a 5 GHz reflector implementation. Further instances of that reflector implementation may be disposed around the dual band driven element to allow for the formation of multiple beams in different directions, for example, a 2 GHz beam in one direction and a 5 GHz beam in a different direction.

The foregoing detailed description has been presented for purposes of illustration and description. It is not intended to be exhaustive or to limit the embodiments of the present invention as modifications and variations are possible and envisioned in light of the above teachings. The described embodiments were chosen in order to best explain the principles of the technology and its practical application to thereby allow one of skill in the art to understand how to implement the same.

What is claimed is:

1. A directional antenna system, the system comprising:

a high-band reflector element; and a low-band reflector element positioned relative the high-band reflector element, wherein the low-band reflector element is a reflecting parasitic element operated to form a directional pattern in a direction perpendicular to a ground plane in a low-frequency band of two distinct frequency bands, and wherein the low-band reflector element includes a meander line coupled directly to the ground plane and having a plurality of short circuited horizontal transmission lines stacked along a vertical direction and connected by vertical sections, each vertical section having a vertical height such that the low-band reflector element is tuned to resonate in the low frequency band, wherein the low-band reflector element is transparent to an antenna pattern emitted by the high-band reflector element, wherein the low-band reflector element is switched on and off without disturbing the antenna pattern emitted by the high-band reflector element.

2. The directional antenna system of claim 1, wherein the low frequency band is at 2.4 GHz and a high frequency band of the two distinct frequency bands is at 5.0 GHz.

3. The directional antenna system of claim 1, wherein the plurality of transmission lines have an electrical length such that the low-band reflector element is transparent to the antenna pattern emitted by the high-band reflector element.

4. The directional antenna system of claim 1, wherein the antenna pattern emitted by the high-band reflector element is not affected by the low-band reflector element.

5. The directional antenna system of claim 1, further comprising:

a second high-band reflector element positioned relative the high-band reflector element; and a second low-band reflector element positioned relative the low band reflector element, the second low-band reflector element having a meander line.

6. The system of claim 1, wherein each of the horizontal transmission lines has substantially the same length.

7. A method for implementing directional antenna patterns in a directional antenna system, the method comprising:

generating a first directional antenna pattern by reflecting a high frequency band of two distinct frequency bands by a high-band reflector element; and generating a second directional antenna pattern in a direction perpendicular to a ground plane by reflecting a low frequency band of the two distinct frequency bands by a low-band reflector element positioned relative the-high band reflector element, wherein the low-band reflector element is a reflecting parasitic element, and wherein the low-band reflector element comprises a meander line coupled directly to the ground plane that includes a plurality of short circuited horizontal transmission lines stacked along a vertical direction and connected by vertical sections, each vertical section having a vertical height such that the low-band reflector element is tuned to resonate in the low frequency band, wherein the low-band reflector element is transparent to the first directional antenna pattern emitted by the high-band reflector element, wherein the low-band reflector element is switched on and off without disturbing the first directional antenna pattern emitted by the high-band reflector element.

8. The method of claim 7, wherein the low frequency band is at 2.4 GHz and the high frequency band is at 5.0 GHz.

9. The method of claim 7, wherein the plurality of transmission lines have an electrical length such that the low-band reflector element is transparent to the first directional antenna pattern emitted by the high-band reflector element.

10. The method of claim 7, wherein the first directional antenna pattern emitted by the high-band reflector element is not affected by the low-band reflector element.

11. The method of claim 7, further comprising:

generating a third antenna pattern at a second high-band reflector element positioned relative the high-band reflector element; and generating a fourth antenna pattern at a second low-band reflector element positioned relative the low band reflector element, the second low-band reflector element having a meander line.

12. The method of claim 7, wherein each of the horizontal transmission lines has substantially the same length.

* * * * *